United States Patent [19]

Austin, Jr. et al.

[11] 4,132,066

[45] Jan. 2, 1979

[54] COMBUSTOR LINER FOR GAS TURBINE ENGINE

[75] Inventors: George W. Austin, Jr., Glastonbury; Robert A. Breton, Old Saybrook; James J. Nolan, Glastonbury; Edmund E. Striebel, South Windsor, all of Conn.

[73] Assignee: United Technologies Corporation, Hartford, Conn.

[21] Appl. No.: 836,119

[22] Filed: Sep. 23, 1977

[51] Int. Cl.[2] ..... F02C 7/18

[52] U.S. Cl. ..... 60/39.65; 60/39.66

[58] Field of Search ..... 60/39.66, 39.65

[56] References Cited

U.S. PATENT DOCUMENTS

| | | | |
|---|---|---|---|
| 3,064,425 | 11/1962 | Hayes | 60/39.66 |
| 3,545,202 | 12/1970 | Batt et al. | 60/39.66 |
| 3,899,876 | 8/1975 | Williamson | 60/39.66 |
| 3,899,882 | 8/1975 | Parker | 60/39.66 |

*Primary Examiner*—Robert E. Garrett

*Attorney, Agent, or Firm*—Norman Friedland

[57] ABSTRACT

This invention relates to an improvement of the cooling air flow distribution in proximity to the combustion and dilution air holes of a combustor liner fabricated from Finwall ® material for a turbine type power plant.

8 Claims, 11 Drawing Figures

FIG. 1 PRIOR ART
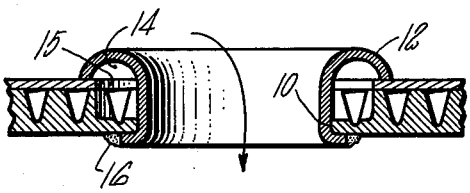
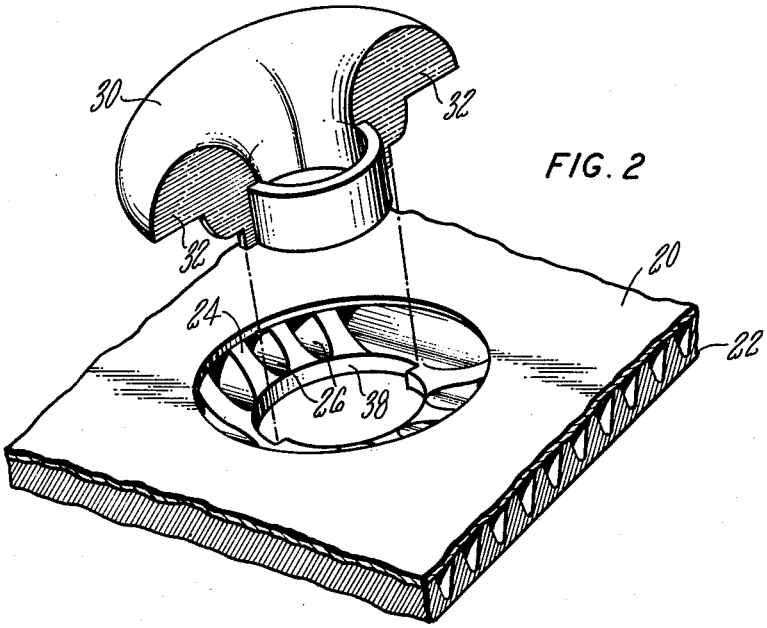
FIG. 2
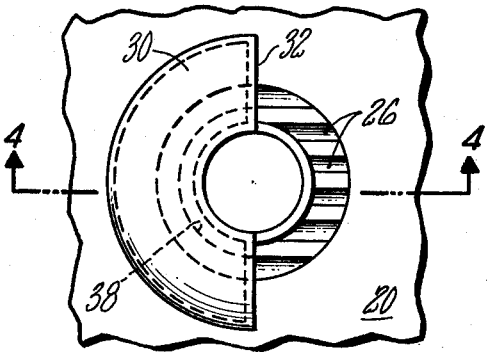
FIG. 3
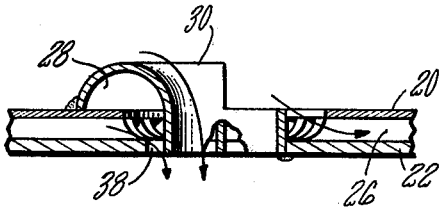
FIG. 4
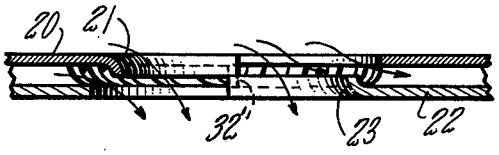
FIG. 11

FIG. 5
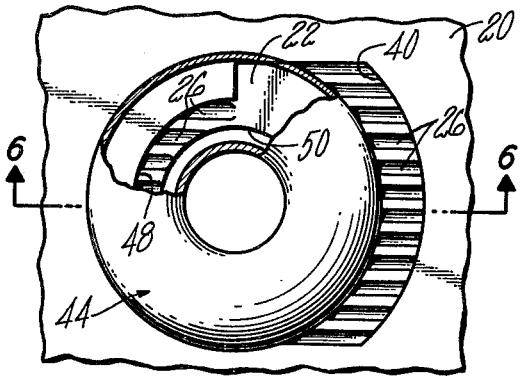
FIG. 6
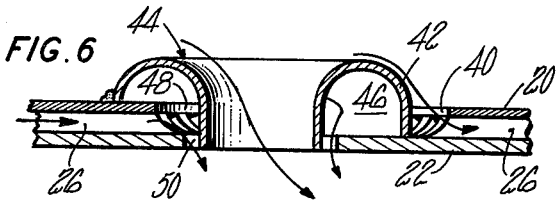
FIG. 7
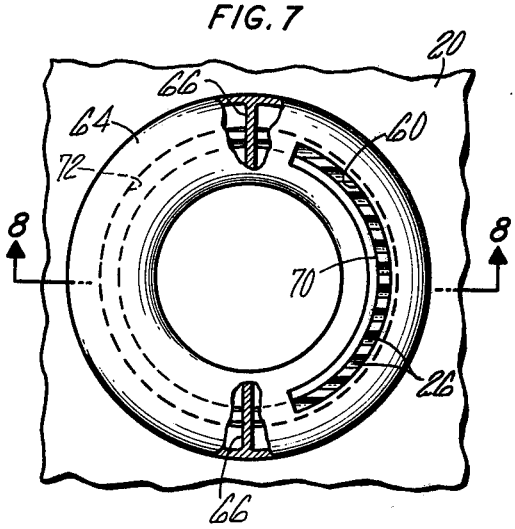
FIG. 8
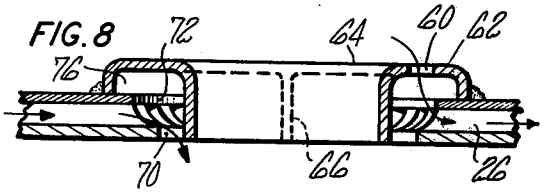
FIG. 9
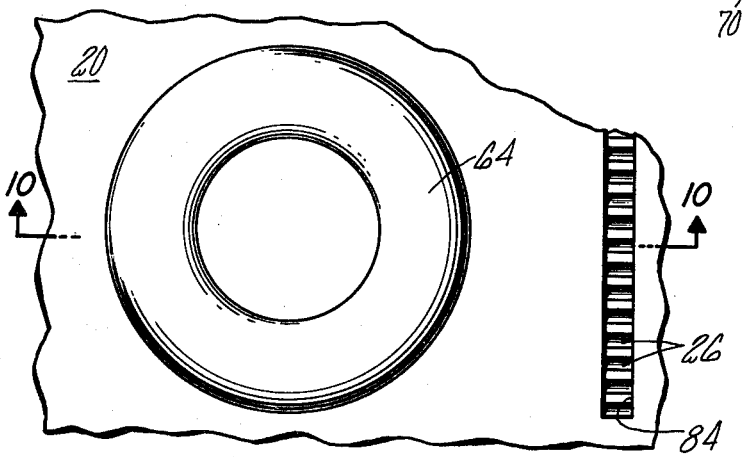
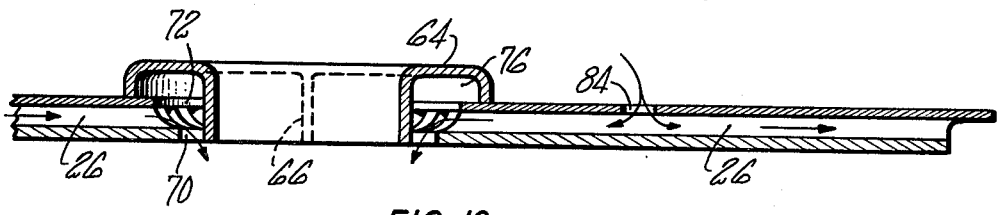
FIG. 10

COMBUSTOR LINER FOR GAS TURBINE ENGINE

BACKGROUND OF THE INVENTION

This invention relates to combustion liners for turbine types of power plants and particularly to the manifolding of cooling air around the combustion and dilution air holes in a Finwall constructed liner.

This invention constitutes an improvement over the cool air manifold means described and claimed in U.S. Pat. No. 3,545,202 granted to Batt et al on Dec. 8, 1970 and assigned to the same assignee as this application and being incorporated herein by reference.

As shown in U.S. Pat. No. 3,545,202, supra, the grommet surrounding the air hole admitting air internally of the combustor is designed for a liner fabricated from Finwall ® constructed panels, which panels are shown therein. As noted from reading this patent, the flow around the grommet is conducted through a header that maintains a continuous flow path in the Finwall channels from upstream to downstream of the grommet. Hence, the air in the Finwall channels immediately upstream of the grommet since it is in direct heat exchange relation with the hot combustion products is at a higher temperature than the cooling air, and conducting it downstream of the grommet has been found, owing to this quantity of heat, to deteriorate the life of the combustor liner at this point. This is illustrated in FIG. 1 showing the prior art where the Finwall constructed panel is drilled to admit combustion air at aperture 10. Grommet 12 surrounds the aperture and is rolled over at the top surface adjacent the cooling air side to form manifold 14. The adjacent fins under the manifold are cut away at 15 so that air flowing in the immediate Finwall channels flows around the grommet from upstream to downstream and flows the full length of the panel, impairing the cooling capabilities of this cooling air. It will also be noted that in actual practice the grommet is secured in place by the 360° weldment 16 to the plate of the Finwall liner exposed to the combustion gases, which has proven to limit the life of this type of construction.

We have found that we can obviate the problems noted above by providing a reentry of fresh cooling air to cool the Finwall passages on the downstream side of the grommet or the combustion or dilution air holes fabricated according to this invention or in installation not using the grommet. Thus, the air adjacent the grommet or combustion and dilution air holes on the upstream end is diverted to discharge into the combustor at the junction points. Additionally, this invention contemplates the elimination of the weldment in its entirety or the relocation thereof to enhance the life of the liner. In a design which requires welding the cold grommet to the hot inner plate it is fundamental that the thermal differences serve to create shear forces in the weld leading to weld cracking. The preferred embodiment requires only a partial weld hence provides for a redistribution and a reduction in stresses, improving weld crack resistance. In another embodiment the elimination of the weld eliminates this failure mode entirely, and obviously, this would be the case when a grommet is not used.

SUMMARY OF THE INVENTION

An object of this invention is to provide for a gas turbine engine an improved combustor liner.

A still further object of this invention is to provide for a combustion liner as described means for reintroducing fresh cooling air in the channels of a Finwall constructed liner panel downstream of the combustion and/or dilution air holes. The grommet is either not welded to this hot sheet or if it is, it doesn't require a 360° weldment as does the prior art devices.

Other features and advantages will be apparent from the specification and claims and from the accompanying drawings which illustrate an embodiment of the invention.

BRIEF DESCRIPTION OF THE DRAWING

FIG. 1 is a partial view illustrating a Finwall burner liner exemplifying the prior art.

FIG. 2 is an exploded perspective view partly in section illustrating one embodiment of this invention.

FIG. 3 is a plan view of FIG. 2.

FIG. 4 is a sectional view taken along the lines 4—4 of FIG. 3.

FIG. 5 is a plan view of another embodiment of the invention.

FIG. 6 is a sectional view taken along lines 6—6 of FIG. 5.

FIG. 7 is a plan view of another embodiment of the invention.

FIG. 8 is a view in section taken along lines 8—8 of FIG. 7.

FIG. 9 is a plan view of another embodiment of this invention.

FIG. 10 is a view in section taken along lines 10—10 of FIG. 9.

FIG. 11 is a partial view in section showing the invention when a grommet is not utilized.

DESCRIPTION OF THE PREFERRED EMBODIMENT

In the context of this disclosure it will be appreciated that this invention relates to improvements in Finwall constructed combustor liners. Finwall material is the material described and claimed in U.S. Pat. No. 3,706,203 granted to P. Goldberg and I. Segalman on Dec. 19, 1972 and assigned to the same assignee as this application, and is incorporated herein by reference. However, it will be appreciated that any fin sandwiched between plates to form open ended channels is within the scope of this invention.

As best seen in FIGS. 2 through 4, the top plate 20, which is exposed to the cooling air, is drilled to form the combustion air hole. Likewise the bottom plate 22 is drilled to form the complimentary aperture for leading the combustion air into the combustor, as clearly shown by the arrow in FIG. 4. The diameter of the opening in plate 20 is larger than the diameter in plate 22 noting that the fins 24 are undercut at this point. In this manner the cooling air flowing in channels 26 is directed to chamber 28 formed by the rolled end of grommet 30 to extend in the 180° arc. Dam or divider 32 mounted in channel 28, one on each side in diametric relation, serves to prevent the flow from flowing 360° around the grommet, as is the case in the one disclosed in U.S. Pat. No. 3,545,202, supra. The air, instead, is forced into the combustion chamber through arcuate slot 38 formed in bottom plate 22. Slot 38 is contiguous to the grommet along the bottom plate and coextensive with the portion of the grommet exposed to the upstream flow.

The downstream end of grommet 30 is cut away, as shown, so that cooling air downstream of dam 32 is readmitted into channels 26 on the downstream end thereof and flows the remaining portion of the panel (not shown). It is noted that the bottom plate, coextensive with the grommet on the downstream end, extends up to the grommet so that the flow on the downstream side is directed into channel 26 as shown by the arrow.

In FIGS. 5 and 6 the reentry flow is admitted in channel 26 on the downstream side in the arcuate slot 40 formed on the downstream end of plate 20 (like elements are designated with like reference numerals). In this embodiment lip 42 of grommet 44 extends the circumference and defines the annular chamber 46. The cooling flow in cchannel 26 on the upstream end is admitted into chamber 46 through the slot 48 formed in plate 20 which extends 180° on the upstream side. Flow migrates around the grommet via chamber 46 and discharges in the annular slot 50 formed adjacent the base of grommet 44 in plate 22. In this embodiment plate 20 on the upstream end is cut away the extent of the slot 40.

FIGS. 7 and 8 disclose another embodiment where the reentry flow is admitted into channel 26 via arcuate slot 60 formed on the lip 62 of grommet 64. Dam like element 66 extends across channel 76 formed by lip 62 dividing the upstream side from the downstream side. Hence flow from channel 26 on the upstream end is dumped into combustor via annular slot 70. Upper plate 20 is drilled to form opening 72 extending under lip 62 permitting a portion of cooling air from the upstream portion of channel 26 to circumscribe the grommet via chamber 76 defined by lip 62.

The grommet 64 in FIGS. 9 and 10 is identical to the design in FIGS. 7 and 8, however, the reentry flow is through slot 84 in plate 20 as shown by the arrows. Similarly, slot 70 dumps upstream cooling air into the combustor and slot 72 shows a portion of the cooling air to surround the grommet via chamber 76.

In another embodiment exemplified by FIG. 11 the combustion or dilution air hole is formed to achieve the same results as described above without employing the grommet. The top plate 20 is cut to form aperture for passing the cooler air into the combustor similarly to that shown in FIG. 2. The end 21 may be rolled slightly inward to form aerodynamically clear turning walls and extends 180° on the upstream side of the hole with respect to the cooling air flow. The under plate 22 is similarly cut and its end 23 may likewise be slightly turned upwardly hence forming a hole for the cooling air flow for combustion or dilution air. The turned portion 23 likewise extends 180° on the downstream end of the hole and meets at diametrically opposed points along the circumference at the mid point of the hole, separately the upstream and downstream sides of the hole. Dam like elements 32, similar to those described in FIG. 2 (elements 32) are inserted at these junction points to prevent the air in the upstream channels from circumscribing the hole and continuing through the downstream channels. Instead the cooling air in the upstream channels will be diverted into the combustion chamber, as illustrated by the arrow.

Downstream of the dam 32' cooling air will be admitted into the channels to continue its flow to the discharge end of the Finwall material.

As shown by this invention the cooling air in the upstream channels of the Finwall panels discharge into the burner in the vicinity of the combustion hole and provide another inlet for fresh cooling air to provide the cooling function for the downstream channels.

All these embodiments eliminate or partially so, the need for a continuous weld between the relatively cold grommet and the hot inner plate 22. This releases much of the thermal fight in the area and prevents the formation of cracks that have regularly developed in the heretofore design.

It should be understood that the invention is not limited to the particular embodiments shown and described herein, but that various changes and modifications may be made without departing from the spirit or scope of this novel concept as defined by the following claims.

We claim:

1. For a combustion chamber having a burner liner comprising inner and outer concentric walls, fins extending therebetween defining therewith open ended channels for directing cooling air therein to flow from an upstream end a predetermined distance and discharge into the combustion chamber at a downstream end, apertures formed in said burner liner to admit combustion or dilution air into the combustion chamber at a point intermediate the upstream and downstream ends of said open ended channels, grommet means in said aperture having a convoluted portion extending from the outer wall remote from said combustion chamber to define therewith a generally annular shaped channel, and a circular portion extending through the outer wall, fins, and inner walls, means for conducting the flow of cooling air adjacent said circular portion at least half way around thereof and discharging said spent cooling air into said combustion chamber through an opening formed in said inner walls adjacent the base of said circular portion, and entrance means formed in said outer wall to admit cooling air into said open ended channels on the downstream side of said grommet with respect to the cooling air flow whereby said fins downstream of said grommet are cooled by reentry of additional cooling air into said open ended channels.

2. For a combustion chamber as in claim 1 including a dam-like element extending into and across said annular shaped channel at the junction point between the upstream and downstream portion of said grommet as viewed from the cooling flow in said open ended channels.

3. For a combustion chamber as in claim 2 where said grommet at said junction point is reduced in height so that the half on the downstream side extend only to the height of said outer wall.

4. For a combustion chamber as in claim 3 wherein said flow conducting means includes an undercut formed in said outer plate and adjacent fins circumscribing said circular portion of said grommet.

5. For a combustion chamber as in claim 1 wherein the fins on the downstream side of said grommet as viewed with respect to the cooling flow in said open ended channels in said annular chamber are removed, and a segmented opening on the downstream side of said convoluted portion formed in said outer wall to readmit cooling air into said open-ended channels.

6. For a combustion chamber as in claim 2 including a segmented opening formed on the convoluted portion on the downstream side of said grommet.

7. For a combustion chamber as in claim 2 wherein cooling air is admitted on the downstream side of said grommet through a slot formed in said outer wall at a point remote from the grommet for directing the reentry of cooling air through said slot upstream to said grommet through said open ended channels into said combustion zone and through said opening formed around said circular portion and downstream of said grommet through said open-ended channels.

8. For a combustion chamber having a burner liner comprising inner and outer concentric walls, fins extending therebetween defining therewith open ended channels for directing cooling air therein to flow from an upstream end a predetermined distance and discharge into the combustion chamber at a downstream end, apertures formed in said burner liner to admit combustion or dilution air into the combustion chamber at a point intermediate the upstream and downstream ends of said open ended channels, an opening extending through said outer wall, fins and inner wall for admitting cooling air flowing over the outer wall into said combustion chamber, dam like elements between the outer and inner walls disposed at diametrically opposed junction points of the midpoint of said opening separating the upstream end from the downstream end in relation to said flow in said channels and means for readmitting cool air in said channels downstream of said dam like elements whereby the flow on the upstream end discharges into the combustion chamber and the reentry of cooling air downstream of said opening passes the remaining portion of the channels interrupted by the formation of said opening.

* * * * *